US010501700B2

(12) United States Patent
Han et al.

(10) Patent No.: US 10,501,700 B2
(45) Date of Patent: Dec. 10, 2019

(54) SHEAR-STABLE OIL COMPOSITIONS AND PROCESSES FOR MAKING THE SAME

(71) Applicant: ExxonMobil Chemical Patents Inc., Baytown, TX (US)

(72) Inventors: Wenning W. Han, Houston, TX (US); Bernie J. Pafford, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 256 days.

(21) Appl. No.: 15/464,518

(22) Filed: Mar. 21, 2017

(65) Prior Publication Data

US 2018/0023018 A1 Jan. 25, 2018

Related U.S. Application Data

(60) Provisional application No. 62/364,628, filed on Jul. 20, 2016.

(30) Foreign Application Priority Data

Sep. 2, 2016 (EP) ..... 16187013

(51) Int. Cl.
*C10M 107/10* (2006.01)
*C10M 111/04* (2006.01)

(52) U.S. Cl.
CPC ..... *C10M 107/10* (2013.01); *C10M 111/04* (2013.01); *C10M 2203/065* (2013.01); *C10M 2205/028* (2013.01); *C10M 2205/0285* (2013.01); *C10M 2207/282* (2013.01); *C10M 2207/283* (2013.01); *C10M 2207/285* (2013.01); *C10M 2207/2825* (2013.01); *C10M 2207/2855* (2013.01); *C10N 2220/021* (2013.01); *C10N 2230/68* (2013.01); *C10N 2240/04* (2013.01)

(58) Field of Classification Search
CPC .... C10M 2205/0285; C10M 2203/065; C10M 2207/2825; C10M 2207/2855; C10N 2230/68; C10N 2220/021
See application file for complete search history.

(56) References Cited

U.S. PATENT DOCUMENTS 3,795,616 A 3/1974 Heilman et al.
5,602,086 A * 2/1997 Le ..... C10M 111/04 508/591
8,476,205 B2 7/2013 Lee et al.
9,127,231 B2 * 9/2015 Carey ..... C10M 111/04
9,234,150 B2 * 1/2016 Martin ..... C10M 169/04
(Continued)

FOREIGN PATENT DOCUMENTS

WO 2010/027454 3/2010

*Primary Examiner* — Vishal V Vasisth
(74) *Attorney, Agent, or Firm* — John R. Wright; Siwen Chen

(57) ABSTRACT

An oil composition comprising a first component having pendant groups, a second component having two or more terminal carbon chains, and optionally a third component, where a single molecule of the second component can form shearable stable structure with two molecules of the first component via van der Waals force between pendant groups and the terminal carbon chains. Shear stability of the oil can be improved if the total concentration of the heavy fraction of the shearable stable structure is controlled at a low concentration.

27 Claims, 1 Drawing Sheet

(56) References Cited

U.S. PATENT DOCUMENTS

| | | | | |
|---|---|---|---|---|
| 2008/0020954 | A1* | 1/2008 | Haigh | C10M 111/04<br>508/384 |
| 2011/0275867 | A1* | 11/2011 | Okada | C10M 107/10<br>585/1 |
| 2013/0184191 | A1 | 7/2013 | Lee et al. | |
| 2013/0210996 | A1 | 8/2013 | Wu et al. | |
| 2014/0187457 | A1 | 7/2014 | Kanga et al. | |

* cited by examiner

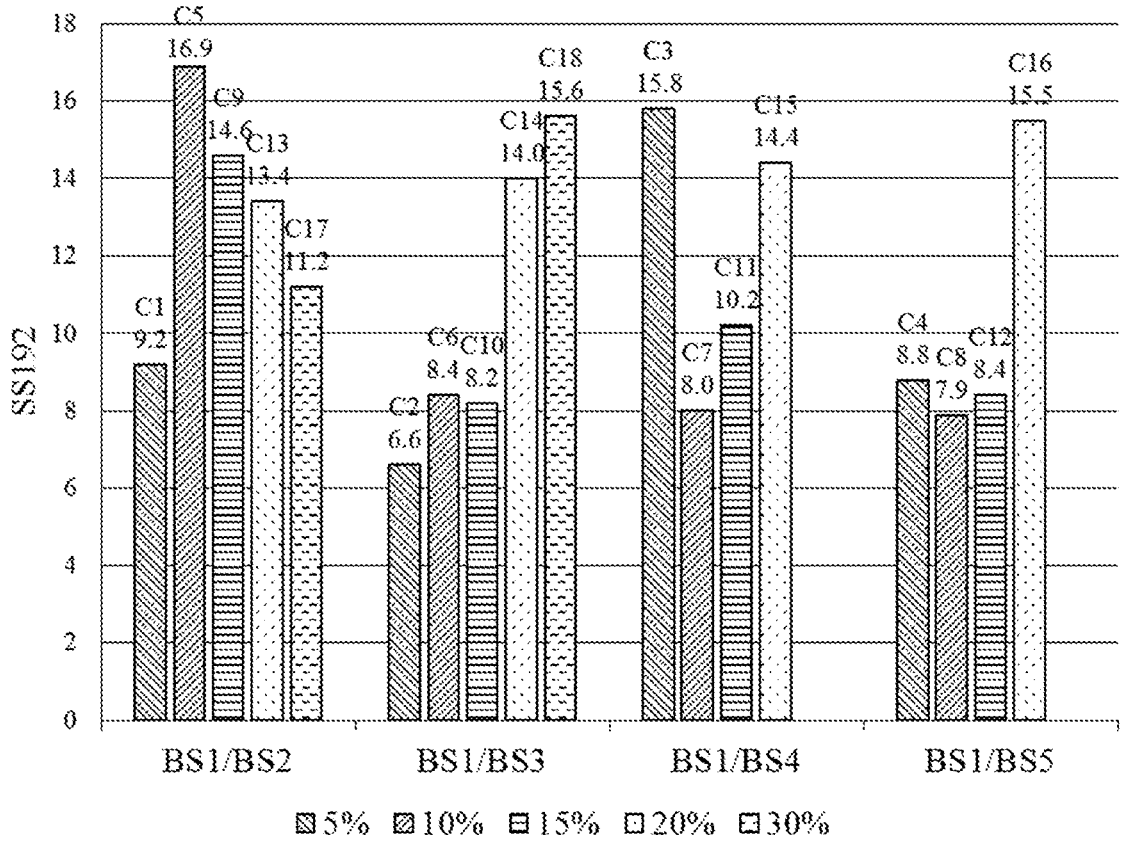
SS192
0
2
4
6
8
10
12
14
16
18
C1 9.2
C5 16.9
C9 14.6
C13 13.4
C17 11.2
C2 6.6
C6 8.4
C10 8.2
C14 14.0
C18 15.6
C3 15.8
C7 8.0
C11 10.2
C15 14.4
C4 8.8
C8 7.9
C12 8.4
C16 15.5
BS1/BS2
BS1/BS3
BS1/BS4
BS1/BS5
5%
10%
15%
20%
30%

SHEAR-STABLE OIL COMPOSITIONS AND PROCESSES FOR MAKING THE SAME

PRIORITY

This application claims priority to and the benefit of U.S. Provisional Application No. 62/364,628, filed Jul. 20, 2016, and EP Application No. 16187013.4, filed Sep. 2, 2016.

FIELD

The present invention relates to oil compositions and processes for making the same. In particular, the present invention relates to shear-stable lubricating oil compositions comprising a hydrocarbon base stock and a co-base stock or an additive. The present invention is useful, e.g., in making lubricant base stock blends with enhanced shear stability particularly suitable for use as gear box oils or other oils subject to repeated high shear stress during normal use.

BACKGROUND

Lubricants in commercial use today are prepared from a variety of natural and synthetic base stocks admixed with various additive packages and solvents depending upon their intended application. The base stocks can include, e.g., Groups I, II and III mineral oils, gas-to-liquid base oils (GTL), Group IV polyalpha-olefins (PAO) including but not limited to PAOs made by using metallocene catalysts (mPAOs), Group V alkylated aromatics (AA) which include but are not limited to alkylated naphthalenes (ANs), silicone oils, phosphate esters, diesters, polyol esters, and the like.

Manufacturers and users of lubricating oil compositions desire to improve performance by extending oil drain life of the lubricating oil composition. Extended drain life is a highly desirable marketing feature of lubricating oil compositions, especially those containing Group IV/Group V base stocks.

Shear stability of the lubricating oil composition affects the oil drain life of the lubricating oil composition, especially those experiencing high-shear stress events during normal use such as gear box oils. Oxidative degradation of lubricating oil composition can lead to damage of metal machinery in which the lubricating oil composition is used. Such degradation may result in deposits on metal surfaces, the presence of sludge, or a viscosity decrease or change in the lubricating oil composition. For gear box oils, significant loss of viscosity during life of the oil can lead to reduced efficacy in lubrication, and hence premature wear and failure of the gears.

The kinematic viscosity of a lubricating oil composition is directly related to the antioxidation performance and degree of oxidation of the lubricating oil composition. A lubricating oil composition being used in machinery has experienced oxidative degradation when the kinematic viscosity of lubricating oil composition reaches a certain level, and the lubricating oil composition needs to be replaced at that level. Improving the oxidation stability and antioxidation performance of the lubricating oil composition improves the oil drain life by increasing the amount of time the lubricating oil composition can be used before being replaced. Various approaches are used to improve the antioxidation performance and extend the oil drain life of Group IV/Group V lubricating oil compositions. The approaches typically involve increasing the antioxidant additive concentrations of the lubricating oil composition.

US 2013/210996 discloses a PAO having a kinematic viscosity at 100° C. of 135 cSt or greater that is derived from not more than 10 mol % ethylene and characterized by a high shear stability demonstrated by, after being subjected to twenty hours of a taper roller bearing testing, having a kinematic viscosity loss of less than 9%. In certain preferred examples in this patent reference, the PAO comprises no more than 5.0 wt % of the polymer having a number-average molecular weight of greater than 45,000. It is disclosed that a low concentration of large PAO molecules (e.g., those having number-average molecular weight of at least 45,000) in the PAO base stock is desired for a high shear stability characterized by a low kinematic viscosity loss after severe shear stability tests.

The above reference is primarily concerned with the shear stability of a single base stock material put into a lubricant oil composition. However, it has been found that, surprisingly, when multiple base stocks or other oil components are mixed, even if each of them exhibits exceedingly low shear loss when tested individually in prolonged shear stability test under severe test conditions, the mixtures of them may exhibit appreciable shear loss when tested under similar conditions. This shows that the various components may interact with each other in the oil, forming shear-unstable objects.

Therefore, there remains the need for oil compositions comprising multiple oil components that exhibit, among other desired properties, a high shear stability. The present invention satisfies this and other needs.

SUMMARY

It has been found that by mixing (i) a first component base stock comprising high-molecular-weight fractions and molecules with long pendant groups with (ii) a low-molecular-weight second component comprising multiple long terminal carbon chains, by controlling a low concentration of a high equivalent number-average molecular weight complex structure formed by the combination of a molecule of the second component and two molecules of the first component via van der Waals force between the pendant groups and the terminal carbon chains, one can achieve a high shear stability of the oil composition.

Thus, a first aspect of the present invention relates to an oil composition comprising a first component and a second component different from the first component. The first component is a base stock comprising multiple molecules of a first type each having multiple pendant groups, where (i) the average pendant group length of the longest 5%, by mole, of the pendant groups of all of the molecules of the first type have an average pendant group length of Lpg(5%), where Lpg(5%)≥5.0; and (ii) a portion of the molecules of the first type have a number-average molecular weight greater than or equal to 20,000. The second component comprises multiple molecules of a second type each comprising two terminal carbon chain, where (a) the number-average molecular weight of the second component is no greater than 2,000; and (b) the two terminal carbon chains have chain lengths equal to or greater than 5.0 and do not share a common carbon atom. A single molecule of the second type is capable of adjoining two molecules of the first type via van der Waals force between the pendant groups of the molecules of the first type and the two terminal carbon chains in the single molecule of the second type to form a first complex structure. The first complex structures comprise a first heavy fraction thereof having an equivalent number-average molecular weight of at least 45,000. The total maximum theoretical concentration of the first heavy fraction of the first complex structure, based on the total weight of the first component and the second component, is C11(max) wt %; and C11(max)≤20.

A second aspect of the present invention relates to process for making the above oil composition.

BRIEF DESCRIPTION OF THE DRAWINGS

FIG. 1 is a chart showing shear viscosity loss (SS192) of a series of oil compositions comprising multiple different types of base stocks at different concentrations.

DETAILED DESCRIPTION

As used herein, a "lubricant" refers to a substance that can be introduced between two or more moving surfaces and lower the level of friction between two adjacent surfaces moving relative to each other. A lubricant "base stock" is a material, typically a fluid at the operating temperature of the lubricant, used to formulate a lubricant by admixing it with other components. Non-limiting examples of base stocks suitable in lubricants include API Group I, Group II, Group III, Group IV, Group V and Group VI base stocks. Fluids derived from Fischer-Tropsch process or Gas-to-Liquid ("GTL") processes are examples of synthetic base stocks useful for making modern lubricants. GTL base stocks and processes for making them can be found in, e.g., WO2005/121280 A1 and U.S. Pat. Nos. 7,344,631; 6,846,778; 7,241,375; 7,053,254.

All fluid "viscosities" described herein, unless specified, refer to the 100° C. kinematic viscosities in centistokes ("cSt") measured according to ASTM D445 100° C. ("KV100"). Reported values of KV40 are kinematic viscosity in centistokes measured according to ASTM D445 at 40° C. All viscosity index ("VI") values are measured according to ASTM D2270.

In the present application, the shear stability of an oil is measured by using the KRL Tapered Roller Bearing Test (CEC L45-A99). Shear stability at 20 hours, 100 hours, and 192 hours are typically measured, and reported as SS20, SS100, and SS192 (as percentages of viscosity loss), respectively. This test is especially useful for determining the amount of shear viscosity loss resulting from the high molecular weight components contained in the oil composition.

In the present disclosure, all percentages of pendant groups, terminal carbon chains, and side chain groups are by mole, unless specified otherwise.

In the present disclosure, the length of a pendant group or a side chain group means the total number of carbon atoms in a carbon chain starting from the first carbon atom therein directly bonded to a carbon backbone (e.g., in the case of a PAO molecule) or a nucleus (e.g., in the case of an alkyl naphthalene molecule) or a heteroatom (e.g., in the case of an ester molecule) of the molecule in question, and ending with the final carbon atom therein connected to no more than one carbon atom, without taking into consideration of any substituents on the chain. Preferably, the pendant group or the side chain group is free of substituents comprising more than 2 carbon atoms (or more than 1 carbon atom), or is free of any substituent.

In the present disclosure, the length of a terminal carbon chain means the total number of carbon atoms in a carbon chain starting from the terminal carbon atom therein and ending at any arbitrary non-terminal carbon atom in the molecule in question, without taking into consideration of any substituents on the chain. A terminal carbon atom is a carbon atom that is connected to one carbon atom and three hydrogen atoms. Preferably, the terminal carbon chain is free of substituents comprising more than 2 carbon atoms (or more than 1 carbon atom), or is free of any substituent.

In the present disclosure, a molecule may comprise two or more terminal carbon chains that do not share a common carbon atom. The two chains are said to extend in directions that form an angle theta. Each terminal carbon chain is said to have an axis assuming that the molecule takes the conformation with the lowest energy at 25° C., which is a hypothetical straight line that has the least total squares of distances to all of the carbon atoms in the terminal carbon chain in question. When parallel and the directions from the terminal to the non-terminal carbon atoms along the axes in the two chains are the same, the two chains are said to form an angle theta of 0°. When parallel and the directions from the terminal to the non-terminal carbon atoms along the axes in the two chains are opposite to each other, the two chains are said to form an angle theta of 180°. When non-parallel and extending from the terminal carbon atom ends to the non-terminal carbon atom ends, the two axes form an angle that is smaller than 180°, which is regarded as the angle theta between the two chains.

In the present disclosure, all molecular weight data are number-average molecular weight, unless specified otherwise. The unit of all molecular weight data is $g \cdot mol^{-1}$. The "equivalent molecular weight" is the total molar mass of a complex structure formed by multiple molecular components via van der Waals force between parts of the molecular components. Molecular weight of oligomer or polymer materials (including conventional, non-metallocene-catalyzed and metallocene-catalyzed PAO materials) in the present disclosure are measured by using Gel Permeation Chromatography (GPC) equipped with a multiple-channel band filter based Infrared detector ensemble IRS (GPC-IR). Equivalent molecular weight of complex structures formed from molecules via van der Waals force can be calculated from the measured molecular weight of the component molecules thereof.

Carbon-13 NMR ($^{13}$C-NMR) is used to determine tacticity of the PAOs of the present invention. Carbon-13 NMR can be used to determine the concentration of the triads, denoted (m,m)-triads (i.e., meso, meso), (m,r)—(i.e., meso, racemic) and (r,r)—(i.e., racemic, racemic) triads, respectively. The concentrations of these triads defines whether the polymer is isotactic, atactic or syndiotactic. In the present disclosure, the concentration of the (m,m)-triads in mol % is recorded as the isotacticity of the PAO material. Spectra for a PAO sample are acquired in the following manner Approximately 100-1000 mg of the PAO sample is dissolved in 2-3 ml of chloroform-d for $^{13}$C-NMR analysis. The samples are run with a 60 second delay and 90° pulse with at least 512 transients. The tacticity was calculated using the peak around 35 ppm ($CH_2$ peak next to the branch point). Analysis of the spectra is performed according to the paper by Kim, I.; Zhou, J.-M.; and Chung, H. Journal of Polymer Science: Part A: Polymer Chemistry 2000, 38 1687-1697. The calculation of tacticity is mm*100/(mm+mr+rr) for the molar percentages of (m,m)-triads, mr*100/(mm+mr+rr) for the molar percentages of (m,r)-triads, and rr*100/(mm+mr+rr) for the molar percentages of (r,r)-triads. The (m,m)-triads correspond to 35.5-34.55 ppm, the (m,r)-triads to 34.55-34.1 ppm, and the (r,r)-triads to 34.1-33.2 ppm.

The present invention concerns with an oil composition (preferably a lubricating oil composition) comprising a first component and at least one of a second component and a third component. Each of these three components can be a typical base stock, a co-base stock, or an additive component. Once admixed, the molecules of these components desirably form a substantially homogeneous mixture such as a solution, where they interact with each other via forces such as ionic bonds, covalent bonds, hydrogen bonds, van der Waals force, and the like. The interaction of the molecules can impart many desirable properties to the mixture, e.g., enhanced performances in oxidation stability, thermal stability, rust inhibition, foaming performance, viscosity index, anti-wear, and the like. However, it has also been found that the interaction can result in deterioration of certain performance of the oil compared to individual components. For example, it has been found, unexpectedly, that the mixture of two base stocks that each individually has excellent shear stability before mixing can exhibit inferior shear stability compared to individual components. Experiments of multiple different combinations of various typical oil components led to the discovery that in mixtures of certain different types of components each having long-chain groups, the different components may join to form significantly larger complex structures via van der Waals force between the groups, which are sufficiently strong and stable, such that under high shear stress conditions, parts of the molecule of one component in the complex structure can break down in locations other than the juncture formed via van der Waals force, as would be experienced by a larger molecule of the same type, leading to shear loss of that component, and resulting in overall reduction in shear stability of the mixture compared to individual component standing alone. Accordingly, the present inventors propose the present inventions.

The First Component

The first component of the oil component of the present invention can be an oil base stock, a blend of multiple oil base stocks, an additive component typical of an oil composition, or the like. The first component is a base stock comprising multiple molecules, which may be the same or different, each having multiple pendant groups on the structures thereof. A preferred, non-limiting example of the first component is a Group IV PAO base stock useful in lubricating oil compositions. Other base stocks, such as Group I, II, III, or V base stocks, may form a part or the entirety of the first component.

PAOs are oligomeric or polymeric molecules produced from the polymerization reactions of alpha-olefin monomer molecules in the presence of a catalyst system, optionally further hydrogenated to remove residual carbon-carbon double bonds therein. Each PAO molecule has a carbon chain with the largest number of carbon atoms, which is designated the carbon backbone of the molecule. Any group attached to the carbon backbone other than to the carbon atoms at the very ends thereof is defined as a pendant group. The number of carbon atoms in the longest carbon chain in each pendant group is defined as the length of the pendant group. The backbone typically comprises the carbon atoms derived from the carbon-carbon double bonds in the monomer molecules participating in the polymerization reactions, and additional carbon atoms from monomer molecules that form the two ends of the backbone. A typical, hydrogenated PAO molecule can be represented by the following formula (F-1):

(F-1)

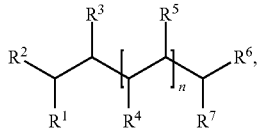

where $R^1$, $R^2$, $R^3$, each of $R^4$ and $R^5$, $R^6$, and $R^7$, the same or different at each occurrence, independently represents a hydrogen or a substituted or unsubstituted hydrocarbyl (preferably an alkyl) group, and n is a non-negative integer corresponding to the degree of polymerization.

Thus, where n=0, (F-1) represents a dimer produced from the reaction of two monomer molecules after a single addition reaction between two carbon-carbon double bonds.

Where n=m, m being a positive integer, (F-1) represents a molecule produced from the reactions of m+2 monomer molecules after m steps of addition reactions between two carbon-carbon double bonds.

Thus, where n=1, (F-1) represents a trimer produced from the reactions of three monomer molecules after two steps of addition reactions between two carbon-carbon double bonds.

Assuming a carbon chain starting from $R^1$ and ending with $R^7$ has the largest number of carbon atoms among all carbon chains existing in (F-1), that carbon chain starting from $R^1$ and ending with $R^7$ having the largest number of carbon atoms constitutes the carbon backbone of the PAO molecule (F-1). $R^2$, $R^3$, each of $R^4$ and $R^5$, and $R^6$, which can be substituted or unsubstituted hydrocarbyl (preferably alkyl) groups, are pendant groups (if not hydrogen).

If only alpha-olefin monomers are used in the polymerization process, and no isomerization of the monomers and oligomers ever occurs in the reaction system during polymerization, about half of $R^1$, $R^2$, $R^3$, all $R^4$ and $R^5$, $R^6$, and $R^7$ would be hydrogen, and one of $R^1$, $R^2$, $R^6$, and $R^7$ would be a methyl, and about half of groups $R^1$, $R^2$, $R^3$, all $R^4$ and $R^5$, $R^6$, and $R^7$ would be hydrocarbyl groups introduced from the alpha-olefin monomer molecules. In a specific example of such case, assuming $R^2$ is methyl, $R^3$, all $R^5$, and $R^6$ are hydrogen, and $R^1$, all $R^4$, and $R^7$ have 8 carbon atoms in the longest carbon chains contained therein, and n=8, then the carbon backbone of the (F-1) PAO molecule would comprise 35 carbon atoms, and the average pendant group length of the pendant groups ($R^2$, and all of $R^4$) would be 7.22 (i.e., (1+8*8)/9). This PAO molecule, which can be produced by polymerizing 1-decene using certain metallocene catalyst systems described in greater detail below, can be represented by formula (F-2) below:

(F-2)

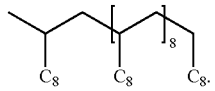

In this molecule, the longest 5%, 10%, 20%, 40%, 50%, and 100% of the pendant groups have average pendant group length of Lpg(5%) of 8, Lpg(10%) of 8, Lpg(20%) of 8, Lpg(50%) of 8, and Lpg(100%) of 7.22, respectively.

Depending on the polymerization catalyst system used, however, different degrees of isomerization of the monomers and/or oligomers can occur in the reaction system during the polymerization process, resulting in different degrees of substitution on the carbon backbone. In a specific example of such case, assuming $R^2$, $R^3$, and all $R^5$ are methyls, $R^6$ is hydrogen, $R^1$ has 8 carbon atoms in the longest carbon chain contained therein, all $R^4$ and $R^7$ have 7 carbon atoms in the longest carbon chain contained therein, and n=8, then the carbon backbone of the (F-1) PAO molecule would comprise 34 carbon atoms, and the average pendant group length of the pendant groups ($R^2$, all $R^4$, and $R^5$) would be 3.67 (i.e., (1+1+7*8+1*8)/18). This PAO molecule, which may be produced by polymerizing 1-decene using certain non-metallocene catalyst systems described in greater detail below, can be represented by the following formula (F-3):

(F-3)

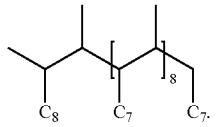

In this molecule, the longest 5%, 10%, 20%, 40%, 50%, and 100% of the pendant groups have average pendant group lengths of Lpg(5%) of 7, Lpg(10%) of 7, Lpg(20%) of 7, Lpg(50%) of 6.3, and Lpg(100%) of 3.67, respectively.

One skilled in the art, with knowledge of the molecular structure or the monomer used in the polymerization step for making the PAO base stock, the process conditions (catalyst used, reaction conditions, e.g.), and the polymerization reaction mechanism, can determine the molecular structure of the PAO molecules, hence the pendant groups attached to the carbon backbone, and hence the Lpg(5%), Lpg(10%), Lpg(20%), Lpg(50%), and Lpg(100%), respectively.

Alternatively, one skilled in the art can determine the Lpg(5%), Lpg(10%), Lpg(20%), Lpg(50%), and Lpg(100%) values of a given PAO base stock material by using separation and characterization techniques available to polymer chemists. For example, gas chromatography/mass spectroscopy machines equipped with boiling point column separator can be used to separate and identify individual chemical species and fractions; and standard characterization methods such as NMR, IR, and UV spectroscopy can be used to further confirm the structures.

PAO base stocks useful for the oil composition of the present invention may be a homopolymer made from a single alpha-olefin monomer or a copolymer made from a combination of two or more alpha-olefin monomers.

Preferable PAO base stocks useful for the oil composition of the present invention are produced from an alpha-olefin feed comprising one or more alpha-olefin monomers having an average number of carbon atoms in the longest carbon chain thereof in a range from Nc1 to Nc2, where Nc1 and Nc2 can be, e.g., 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, or 16.0, as long as Nc1<Nc2. The "alpha-olefin feed" may be supplied to the polymerization reactor continuously or batch-wise. Each of the alpha-olefin monomer may comprise from 4 to 32 carbon atoms in the longest carbon chain therein. Preferably, at least one of the alpha-olefin monomer is a linear alpha-olefin (LAO). Preferably, the LAO monomers have even number of carbon atoms. Non-limiting examples of the LAOs include but are not limited to 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene in yet another embodiment. Preferred LAO feeds are 1-hexene, 1-octene, 1-decene, 1-dodecene, 1-tetradecene, 1-hexadecene and 1-octadecene. Preferably, the alpha-olefin feed comprises ethylene at a concentration not higher than 1.5 wt % based on the total weight of the alpha-olefin feed. Preferably, the alpha-olefin feed is essentially free of ethylene. Examples of preferred LAO mixtures as monomers for making the PAO useful in the oil composition of the present invention include, but are not limited to: C6/C8; C6/C10; C6/C12; C6/C14; C6/C16; C6/C8/C10; C6/C8/C12; C6/C8/C14; C6/C8/C16; C8/C10; C8/C12; C8/C14; C8/C16; C8/C10/C12; C8/C10/C14; C8/C10/C16; C10/C12; C10/C14; C10/C16; C10/C12/C14; C10/C12/C16; and the like.

During polymerization, the alpha-olefin monomer molecules react with components in or intermediates formed from the catalyst system and/or each other, resulting in the formation of covalent bonds between carbon atoms of the carbon-carbon double bonds of the monomer molecules, and eventually, an oligomer or polymer formed from multiple monomer molecules. The catalyst system may comprise a single compound or material, or multiple compounds or materials. The catalytic effect may be provided by a component in the catalyst system per se, or by an intermediary formed from reaction(s) between components in the catalyst system.

The catalyst system may be a conventional catalyst based on a Lewis acid such as $BF_3$ or $AlCl_3$, or a Friedel-Crafts catalyst. During polymerization, the carbon-carbon double bonds in some of the olefin molecules are activated by the catalytically active agent, which subsequently react with the carbon-carbon double bonds of other monomer molecules. It is known that the thus activated monomer and/or oligomers may isomerize, leading to a net effect of the shifting or migration of the carbon-carbon double bonds and the formation of multiple short-chain pendant groups, such as methyl, ethyl, propyl, and the like, on the carbon backbone of the final oligomer or polymer macromolecules. Therefore, the average pendant group length of PAOs made by using such conventional Lewis acid-based catalysts can be relatively low.

Alternatively or additionally, the catalyst system may comprise a non-metallocene Ziegler-Natta catalyst. Alternatively or additionally, the catalyst system may comprise a metal oxide supported on an inert material, e.g., chromium oxide supported on silica. Such catalyst system and use thereof in the process for making PAOs are disclosed in, e.g., U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine), the relevant portions thereof are incorporated herein by reference in their entirety.

Preferably, the catalyst system comprises a metallocene compound and an activator and/or cocatalyst. Such metallocene catalyst system and method for making metallocene mPAOs using such catalyst systems are disclosed in, e.g., WO 2009/148685 A1, the content of which is incorporated herein by reference in its entirety.

Generally, when a supported chromium oxide or metallocene-containing catalyst system is used, isomerization of the olefin monomers and/or the oligomers occurs less frequently, if at all, than when a conventional Lewis acid-based catalyst such as $AlCl_3$ or $BF_3$ is used. Therefore, the average pendant group length of PAOs made by using these catalysts (i.e., mPAOs and chromium oxide PAOs, or chPAOs), can reach or approach the theoretical maximum, i.e., where no shifting of the carbon-carbon double bonds occurs during polymerization. Therefore, in the oil composition of the present invention, PAO base stocks made by using metallocene catalysts or supported chromium oxide catalysts (i.e., mPAOs and chPAOs) are preferred, assuming the same monomer(s) is used.

Thus, in the oil composition of the present invention, the PAO base stock comprises a plurality of oligomeric and/or polymeric PAO molecules, which may be the same or different. Each PAO molecule comprises a plurality of pendant groups, which may be the same or different, and the longest 5%, 10%, 20%, 40%, 50%, and 100% of the pendant groups of all of the molecules of the PAO base stock have an average pendent group length of Lpg(5%), Lpg(10%), Lpg(20%), Lpg(40%), Lpg(50%), and Lpg(100%), respectively. It is preferred that at least one of the following conditions is met:

(i) a1≤Lpg(10%)≤a2, where a1 and a2 can be, independently, 7.0, 7.5, 8.0, 8.5, 9.0, 9.5, 10.0, 10.5, 11.0, 11.5, or 12.0, as long as a1<a2;

(ii) b1≤Lpg(10%)≤b2, where b1 and b2 can be, independently, 7.0, 7.5, 8.0, 8.5, 9.0, 9.5, 10.0, 10.5, 11.0, 11.5, or 12.0, as long as b1<b2;

(iii) c1≤Lpg(20%)≤c2, where c1 and c2 can be, independently, 6.5, 7.0, 7.5, 8.0, 8.5, 9.0, 9.5, 10.0, 10.5, or 11.0, as long as c1<c2;

(iv) d1≤Lpg(40%)≤d2; where d1 and d2 can be, independently, 6.0, 6.5, 7.0, 7.5, 8.0, 8.5, 9.0, 9.5, 10.0, 10.5, or 11.0, as long as d1<d2;

(v) e1≤Lpg (50%)≤e2; where e1 and e2 can be, independently, 5.5, 6.0, 6.5, 7.0, 7.5, 8.0, 8.5, 9.0, or 9.5, as long as e1<e2; and (vi) f1≤Lpg(100%)≤f2, where f1 and f2 can be, independently, 5.0, 5.5, 6.0, 6.5, 7.0, 7.5, 8.0, 8.5, or 9.0, as long as f1<f2.

Preferably, at least 60% of the pendent groups on the PAO molecules in the PAO base stock are straight chain alkyls having at least 6 carbon atoms. Preferably, at least 90% of the pendent groups on the PAO molecules in the PAO base stock are straight chain alkyls having at least 6 carbon atoms. Preferably, at least 60% of the pendent groups on the PAO molecules in the PAO base stock are straight chain alkyls having at least 8 carbon atoms. Preferably, at least 90% of the pendent groups on the PAO molecules in the PAO base stock are straight chain alkyls having at least 8 carbon atoms.

The PAO base stock useful in the present invention may have various levels of regio-regularity. For example, each PAO molecule may be substantially atactic, isotactic, or syndiotactic. The PAO base stock, however, can be a mixture of different molecules, each of which can be atactic, isotactic, or syndiotactic. Without intending to be bound by a particular theory, however, it is believed that regio-regular PAO molecules, especially the isotactic ones, due to the regular distribution of the pendant groups, especially the longer ones, tend to align better with the AA base stock molecules, as discussed below, and therefore preferred. Thus, it is preferred that at least 50%, or 60%, or 70%, or 80%, or 90%, or even 95%, by mole, of the PAO base stock molecules are regio-regular. It is further preferred that at least 50%, or 60%, or 70%, or 80%, or 90%, or even 95%, by mole, of the PAO base stock molecules are isotactic. PAO base stocks made by using metallocene catalysts can have such high regio-regularity (syndiotacticity or isotacticity), and therefore are preferred. For example, it is known that a metallocene-based catalyst system can be used to make PAO molecules with over 70%, 75%, 80%, 85%, 90%, 95%, or even substantially 100% isotacticity.

The PAO base stock useful for the present invention can have various viscosity. For example, it may have a KV100 in a range from 1 to 5000 cSt, such as 1 to 3000 cSt, 2 to 2000 cSt, 2 to 1000 cSt, 2 to 800 cSt, 2 to 600 cSt, 2 to 500 cSt, 2 to 400 cSt, 2 to 300 cSt, 2 to 200 cSt, or 5 to 100 cSt. The exact viscosity of the PAO base stock can be controlled by, e.g., monomer used, polymerization temperature, polymerization residence time, catalyst used, concentration of catalyst used, distillation and separation conditions, and mixing multiple PAO base stocks with different viscosity.

In general, it is desired that the PAO base stock used in the oil composition of the present invention has a bromine number in a range from Nb(PAO)1 to Nb(PAO)2, where Nb(PAO)1 and Nb(PAO)2 can be, independently, 0, 0.2, 0.4, 0.5, 0.6, 0.8, 1.0, 1.5, 2.0, 2.5, 3.0, 3.5, 4.0, 4.5, 5.0, as long as Nb(PAO)1<Nb(PAO)2. To reach such a low bromine number, it may be desired that the PAO used in the oil composition of the present invention has been subjected to a step of hydrogenation where the PAO has been in contact with a $H_2$-containing atmosphere in the presence of a hydrogenation catalyst, such as Co, Ni, Ru, Rh, Ir, Pt, and combinations thereof, such that at least a portion of the residual carbon-carbon double bonds present on the PAO molecules become saturated.

Examples of commercial PAO base stocks useful for the oil composition of the present invention include, but are not limited to: SpectraSyn™ synthetic non-metallocene PAO base stocks, SpectraSyn Ultra™ series chromium oxide-based PAO base stocks, and SpectraSyn Elite™ series mPAO base stocks, all available from ExxonMobil Chemical Company located at Houston, Tex., U.S.A.

Molecular structures of exemplary mPAO made from a mixture of 1-octene and 1-dodecene alpha-olefin monomers at a molar ratio of 4:1 can be schematically represented as follows, where n can be any integer.

(F-3a)

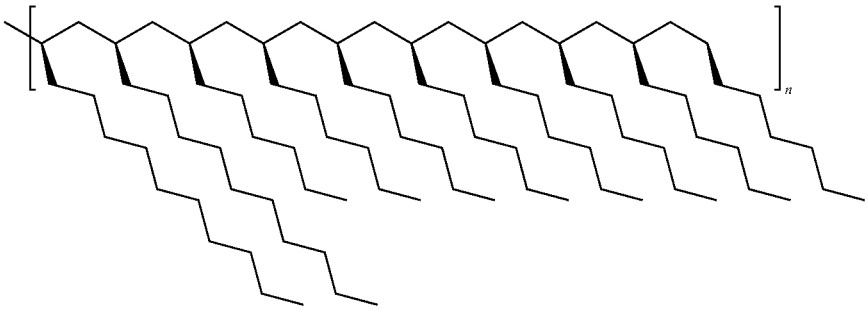

The two C10 pendant groups are shown to be next to each other. In real molecules, they may be randomly distributed among all of the pendant groups. The structure shows 100% isotacticity, i.e., 100 mol % of (m,m)-triads in the structure. In real molecules, a small fraction may be (m,r) or (r,r) triads. Nonetheless, the highly regular pendant groups can extend to form a substantially straight chain in a solution, and interact with other long carbon chains from other mPAO molecules, co-base stock molecules, or additive molecules. If two long carbon chain are aligned, which they can during molecular movement, vibration and relaxation, they may form a sufficiently strong linkage via van der Waals force, much similar to what occurs in long-chain polymers such as polyethylene, polypropylene, and the like.

The Second Component

The second component comprises multiple molecule of the second type each comprising at least two terminal carbon chains that do not share a common carbon atom, wherein at least two of the terminal carbon chains have chain lengths equal to or greater than 5.0. By "terminal carbon chain" is meant a carbon chain that ends with a carbon atom that is not connected to more than one carbon. The at least two terminal carbon chains are each capable of forming sufficiently strong bonding with pending groups of two or more separate molecules of the first type, thereby forming a complex structure comprising at least two molecules of the first type and at least one molecule of the second type. Desirably both of the terminal chains are free of substitution on the carbon chain having a length of at least 5.0. Long, carbon chains would have less steric hindrance when attaching to pendant groups of molecules of the first type. It is possible, however, that one or both of the terminal chains are substituted by short carbon chains, such as methyl, ethyl, propyl, and the like. The complex structure is significantly larger than each of the molecules of the first type and the second component before they join together. Where the underlying constituent molecules of the first type and the second component are sufficiently large, the complex structure can become so large that, when experiencing exceedingly high shear stress events, such as passing through high-pressure contact points between gear surfaces typically seen in gear boxes, vulnerable portions in the complex structure can be torn apart.

The second component can be a base stock, a co-base stock, or an additive component blended together with the first component in an oil composition. The second component is typically not an aliphatic hydrocarbon or mixtures thereof (e.g., PAOs). PAO molecules, though typically containing two or more long carbon chains, tend not to form strong complex structures with each other via van der Waals force between the carbon chains. Without intending to be bound by a particular theory, this is believed to be due to the relatively large molecular sweep volume, and therefore inefficient and relatively weak coupling between the molecules. A specific type of the second component is an alkylated aromatic base stock typically used in lubricant oils, described below.

Alkylated aromatic base stocks ("AA base stock") typically comprise molecules that may be represented by the following formula (F-4):

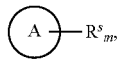

(F-4)

where circle A represents an aromatic ring structure such as the substituted or unsubstituted ring structure, single or fused, of benzene, biphenyl, triphenyl, naphthalene, anthracene, phenanthrene, benzofuran, and the like, and $R^s$, the same or different at each occurrence, independently represents a substituted or unsubstituted hydrocarbyl group (preferably an alkyl group) attached to the aromatic ring structure, and m is a positive integer. For AA base stocks useful as the second component of the oil compositions of the present invention, $m \geq 2$. Each $R^s$ is defined as a side chain group, which would constitute terminal carbon chains that do not share a common atom. The total number of carbon atoms in the longest carbon chain with one end attaching to the aromatic ring in each $R^s$ is defined as the length of the side chain group or the length of the terminal carbon chain. Thus, as specific examples of formula (F-4) compounds, 2-n-dodecyl-7-n-dodecyl-naphthalene would have an average side chain group length of 12, while 1-methyl-7-n-dodecyl-naphthalene would have an average side chain group length of 6.5. Their structures are illustrated as follows in formulae (F-5) and (F-6), respectively:

(F-5)

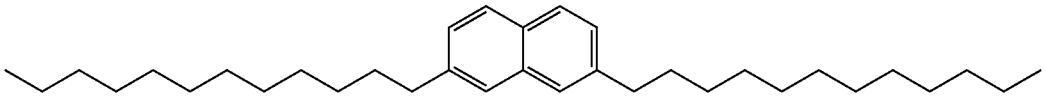

, and (F-6)

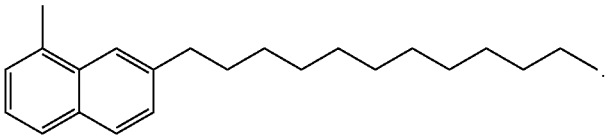

.

The (F-5) molecule would be useful as the second component of the oil composition of the present invention because each terminal carbon chain has more than 5 carbon atoms. The (F-6) molecule would not be useful as the second component of the oil component of the present invention because one terminal carbon chain has fewer than 5 carbon atoms therein.

Preferred AA base stocks include alkylated naphthalenes base stock ("AN base stock") having a naphthalene ring to which one or more substituted or non-substituted alkyl side chain group(s), the same or different, is attached. For example, a preferred AN base stock comprises a mixture of n-C16-alkyl substituted naphthalenes, 1-methyl-n-C15-alkyl substituted naphthalenes at the one or more locations on the naphthalene nucleus. Such AN base stock is commercially available from ExxonMobil Chemical Company, Houston, Tex., U.S.A., as Synnestic™ AN. For the purpose of the present application, the n-C16-alkyl side chain group is considered to have a side group length (Lsc) of 16, and the 1-methyl-C15-alkyl is considered to have an Lsc of 15. Thus, for 1-n-C16-alkyl-2-(1-methyl-1-n-C15-alkyl)-naphthalene, the average Lsc of the longest 5%, 10%, 20%, 40%, 50%, and 100% of the side chain groups, which are referred to as Lsc(5%), Lsc(10%), Lsc(20%), Lsc(40%), Lsc(50%), and Lsc(100%), respectively, are 16, 16, 16, 16, 16, 15.5, respectively.

In general, it is desired that the AA base stock molecules in the blends of the present invention have an average side chain group length of the longest 5% of the side chain groups of Lsc(5%) in a range from Lsc(5%)1 to Lsc(5%)2, where Lsc(5%)1 and Lsc(5%)2 can be, independently, 10, 11, 12, 13, 14, 15, 16, 17, 18, 19, 20, as long as Lsc(5%)1<Lsc(5%)2.

In general, it is desired that the AA base stock molecules in the blends of the present invention have an average side chain group length of the longest 10% of the side chain groups of Lsc(10%) in a range from Lsc(10%)1 to Lsc(10%)2, where Lsc(10%)1 and Lsc(10%)2 can be, independently, 10, 11, 12, 13, 14, 15, 16, 17, 18, 19, 20, as long as Lsc(10%)1<Lsc(10%)2.

It is further desired that the AA base stock molecules in the blends of the present invention have an average side chain group length of the longest 20% of the side chain groups of Lsc(20%) in a range from Lsc(20%)1 to Lsc(20%)2, where Lsc(20%)1 and Lsc(20%)2 can be, independently, 10, 11, 12, 13, 14, 15, 16, 17, 18, 19, 20, as long as Lsc(20%)1<Lsc(20%)2.

It is further desired that the AA base stock molecules in the blends of the present invention have an average side chain group length of the longest 40% of the side chain groups of Lsc(40%) in a range from Lsc(40%)1 to Lsc(40%)2, where Lsc(40%)1 and Lsc(40%)2 can be, independently, 10, 11, 12, 13, 14, 15, 16, 17, 18, 19, 20, as long as Lsc(40%)1<Lsc(40%)2.

It is further desired that the AA base stock molecules in the blends of the present invention have an average side chain group length of the longest 50% of the side chain groups of Lsc(50%) in a range from Lsc(50%)1 to Lsc(50%)2, where Lsc(50%)1 and Lsc(50%)2 can be, independently, 10, 11, 12, 13, 14, 15, 16, 17, 18, 19, 20, as long as Lsc(50%)1<Lsc(50%)2.

It is further desired that the AA base stock molecules in the blends of the present invention have an average side chain group length of all of the side chain groups of Lsc(100%) in a range from Lsc(100%)1 to Lsc(100%)2, where Lsc(100%)1 and Lsc(100%)2 can be, independently, 10, 11, 12, 13, 14, 15, 16, 17, 18, 19, 20, as long as Lsc(100%)1<Lsc(100%)2.

One skilled in the art, with knowledge of the molecular structure or the chemicals used in process for making the AA base stock, the process conditions (catalyst used, reaction conditions, e.g.), and the reaction mechanism, can determine the molecular structure of the AA base stock molecules, hence the side chain groups attached to the aromatic ring, and hence the Lsc(5%), Lsc(10%), Lsc(20%), Lsc(50%), and Lsc(100%), respectively.

Alternatively, one skilled in the art can determine the Lsc(5%), Lsc(10%), Lsc(20%), Lsc(50%), and Lsc(100%) values of a given AA base stock material by using separation and characterization techniques available to organic chemists. For example, gas chromatography/mass spectroscopy machines equipped with boiling point column separator can be used to separate and identify individual chemical species and fractions; and standard characterization methods such as NMR, IR, and UV spectroscopy can be used to further confirm the structures.

Desirably, in the oil composition of the present invention, the alkylated aromatic base stock has a bromine number in the range from Nb(AA)1 to Nb(AA)2, where Nb(AA)1 and Nb(AA)2 can be, independently, 0, 0.2, 0.4, 0.5, 0.6, 0.8, 1.0, 1.5, 2.0, 2.5, 3.0, as long as Nb(AA)1<Nb(AA)2.

The AA base stock useful in the oil composition of the present invention may be produced by, e.g., alkylating an aromatic compound by an alkylating agent in the presence of an alkylation catalyst. For example, alkylbenzene base stocks can be produced by alkylation of benzene or substituted benzene by a LAO, alkyl halides, alcohols, and the like, in the presence of a solid acid such as zeolites. Likewise, alkylated naphthalene bases stocks can be produced by alkylation of naphthalene or substituted benzene by a LAO, alkyl halides, alcohols, and the like, in the presence of a solid acid such as zeolites.

Additional materials useful for the second component of the oil composition of the present invention include ester-type base stocks comprising two or more long straight alkyl chains in the molecules thereof. Such esters can be, but are not limited to: long-chain carboxylic acid esters of polyalcohols or long-chain alcohol esters of polyacids; phosphates, sulphates, and sulphonates of long-chain alcohols. Exemplary esters useful as the second component are:

(F-7)

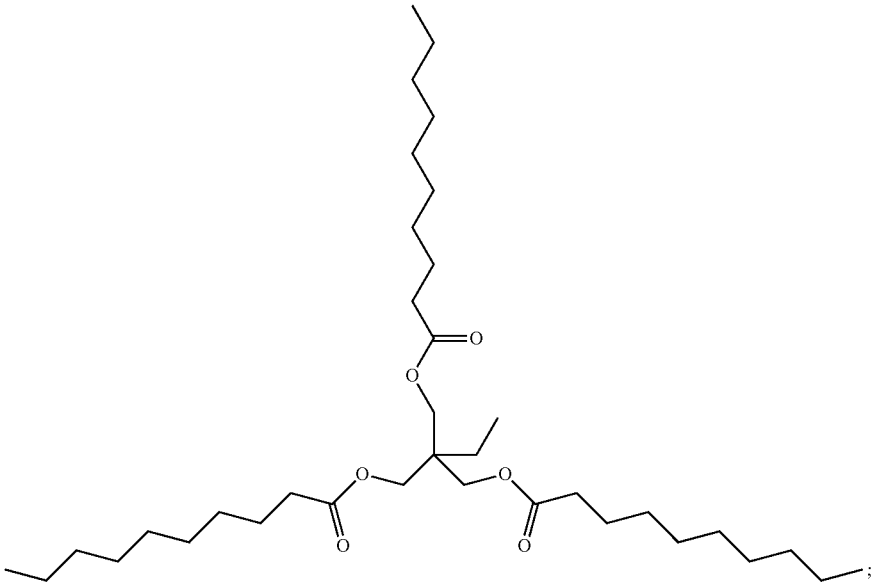

2-((decanoyloxy)methyl)-2-ethylpropane-1,3diyl bis(decanoate)

(F-8)

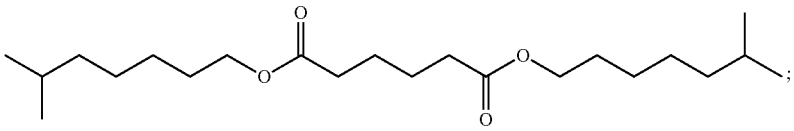

bis(6-methylheptyl) adipate (F-9)

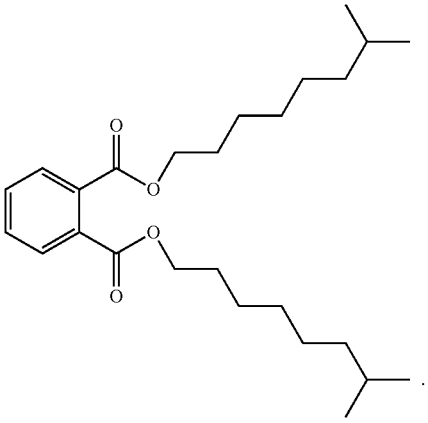

bis(7-methyloctyl) phthalate

The three long straight terminal alkyl chains in (F-7), when extended and relaxed, can align with the pendant groups of one or more molecules of the first type, described above. When completely relaxed, the three alkyl groups extend in directions that form an angle theta of about 109° relative to each other. The two long straight terminal alkyl chains in (F-9), when extended and relaxed, can align with the pendant groups of one or more molecules of the first type as well. When completely relaxed, the two alkyl groups extend in directions that form an angle theta of about 60° relative to each other. The two long straight terminal alkyl chains in formula (F-8), when completely relaxed, extend in directions that form an angle theta of about 180° relative to each other. As can be seen, when two terminal alkyl chains in (F-7) or (F-9) link with two pendant groups of two molecules of the first type of the first component, such as an mPAO material, the carbon backbones of the two molecules of the first type would experience substantial steric hindrance, resulting in a non-parallel relationship between them. However, when two terminal alkyl chains in (F-8) link with two pendant groups of two molecules of the first type of the first component, such as an mPAO material, the carbon backbones of the two molecules of the first type would experience significantly less steric hindrance compared to the structure formed from the (F-7) molecule above, which can be substantially parallel or non-parallel. The probability that between two large molecular weight molecules of the first type multiple molecules of (F-8) structure exist is much higher than the probability that multiple molecules of (F-7) or (F-9) does.

The second type of molecules contained in the second component desirably have a number-average molecular weight of no more than 2000, preferably no more than 1500, 1,000, 800, 600, or even 500. Small molecules of the second type tend to interact more effectively with two or more molecules of the first type to form large equivalent molecular weight, shearable complex structures.

The Third Component

The optional third component in the oil compositions of the present invention, contrary to the second component, comprises multiple molecules of the third type that are incapable of adjoining two molecules of the first type via van der Waals force to form a stable complex structure, the complex structures comprising a first heavy fraction thereof having a number-average molecular weight of at least 45,000. However, the third component may be capable of adjoining one molecule of the first type.

The third type component may comprise any Group I, II, III, IV, or V base stocks and additive components for lubricating oil compositions. For example, the third component may comprise, in part or in whole, a PAO base stock or an AA base stock described above in connection with the first component or the second component. A molecule of the third component may comprise two long-chain alkyl groups that are substantially sterically hindered, such that only one of them may align with a pendant group of a molecule of the first type described above to form a complex structure via van der Waals force. Where the angle theta between the two terminal chains is no more than 45°, the steric hindrance is so severe that one can consider the molecule to be substantially incapable of adjoining two molecules of the first type through interaction with two pendant groups of the two molecules of the first type via van der Waals force.

The third component may comprise just one straight long-chain alkyl group on its molecular structure, such as one with formula (F-6) above.

PAO molecules, though typically containing two or more long carbon chains, tend not to form strong complex structures with each other via van der Waals force between the carbon chains. Without intending to be bound by a particular theory, this is believed to be due to the relatively large molecular sweep volume, and therefore inefficient and relatively weak coupling between the molecules. Therefore, PAO base stocks are preferred for the optional third component in the oil composition of the present invention.

The molecules of the third type contained in the third component desirably have a number-average molecular weight of no more than 2000, preferably no more than 1500, 1,000, 800, 600, or even 500. Small molecules of the third type are less likely to interact with molecules of the first type to form shearable complex structures having a large equivalent molecular weight.

The Oil Composition

Different types of base stocks may be blended to form a formulated lubricant composition to provide desired properties of the lubricant composition. In certain situations, the molecules of these different types of base stocks may interact to produce a synergistic effect. For example, it is known that conventional PAO base stocks, when mixed with alkylated naphthalene base stocks, enhanced oxidation stability can be achieved. Such effect is described in, e.g., U.S. Pat. No. 5,602,086.

The oil composition of the present invention comprises a first component such as a PAO base stock, a second component, and optionally a third component, each described in detail above.

Shear stability of a lubricating oil composition indicates the viscosity change of the oil composition after having been exposed to high shear stress events for a prolonged period of time. Lubricating oil compositions used to lubricate surfaces in close contact, such as the surfaces of gears in gear boxes, automotive transmissions, differentials, clutch boxes, and the like, may be subjected to repeated high-shear stress events. The bond energy of C—C single bond is about 346 $kJ \cdot mol^{-1}$. It is known that, small hydrocarbon molecules, or those with a very slim structure (such as a completely linear structure with no pendant groups), can slip through the surface contact during transient high shear stress event before a C—C bond breaks. Very large hydrocarbon molecules, such as those with molecular weight of higher than 60,000 and multiple pendant groups thereon leading to large size of the molecules, can be subjected to extraordinarily large shear stress during normal use thereof that is sufficient to break a covalent C—C single bond in the molecule, leading to the formation of smaller molecules, and eventually loss of components with the highest molecular weights, and consequently, reduction of viscosity of the oil composition. Therefore, shear stability of a lubricating oil composition has traditionally been measured in terms of viscosity loss under a controlled measurement condition featuring predetermined high shear stress events under a given temperature for a predetermined duration, such as 20 hours, 100 hours, or 192 hours.

In a surprising manner, the present inventors have found that, the mixture of two base stocks, each of which exhibits very high shear stability under severe shear stability test conditions with exceptionally low shear viscosity loss, and both of which would otherwise not react with other to form covalent bonds during such severe shear stability test conditions, may nonetheless demonstrate appreciable shear viscosity loss under the same testing conditions to different degrees depending on the nature and quantity of the two base stocks in the mixture. This suggests that interaction between the molecules of the base stocks resulted in the formation of structures more vulnerable to high-shear stress conditions without chemical reactions between them. After more in-depth investigation, we found that base stocks each having long-chain straight alkyl groups in their molecules tend to exhibit such shear loss behavior when mixed. We conclude that this is because relatively large, strong and stable complex structure formed between the molecules via van der Waals force between the long-chain straight alkyls resulted in the breakage of C—C covalent bonds in some of the base stock molecules during high-shear stress events, similar to what would occur to very large hydrocarbon molecules, such as the PAO molecules having molecular weights of higher than 60,000 that are formed completely through covalent bonds. While such complex structures would most likely break at the location of the links formed via van der Waals force because such force typically is not as strong as a C—C covalent bond, it is likely that in certain percentage of such complex structures, the existence of the van der Waals linkage through the interaction of long-chain groups does lead to the larger overall structure, and eventual breakage of some C—C bonds because they are exposed to higher stress than the van der Waals linkage. We also found that the shear viscosity loss depends on the total maximum theoretical concentration of the fraction of the complex structures with a high total equivalent molecular weight (where the first complex structure is treated as if it were a molecule in the traditional sense—i.e., all atoms are connected via covalent bonds to form the entirety of the first complex structure).

Thus, in the oil composition of the present invention, the total maximum theoretical concentration of the first heavy fraction of the first complex structure having equivalent molecular weight of at least 45,000 (C11) is no more than 25 wt % (preferably no more than 20 wt %, 18 wt %, 15 wt %, 10 wt %, 8 wt %, 5 wt %, 3 wt %, or even 1 wt %) based on the total weight of the first component and the second component. Even more preferably, the total maximum theoretical concentration of the first heavy fraction of the first complex structure having equivalent molecular weight of at least 60,000 (C21) is no more than 25 wt % (preferably no more than 20 wt %, 18 wt %, 15 wt %, 10 wt %, 8 wt %, 5 wt %, 4 wt %, 3 wt %, 2 wt %, or even 1 wt %) based on the total weight of the first component and the second component.

The total maximum theoretical concentration of the first heavy fraction of the first complex structure can be determined from the molecular weight distributions of the first component and the second component. When calculating the total maximum theoretical concentration of the first complex structure having equivalent molecular weight of a given value (e.g., 45,000), one would assume that all molecules of the first type and all molecules of the second type capable of forming such complex structure having such high equivalent molecular weight indeed form such structure to the extent either all molecules of the first type or all molecules of the second type available for such formation are consumed. In reality, due to the nature of van der Waals force, there exists an equilibrium between the first complex structure and the free molecules of the first type and the second type. However, the maximum theoretical concentration is a good indicator of the shear stability of the oil comprising a mixture of the first component and the second component.

Thus, in one case, assuming the second component is a small molecule base stock material (e.g., with an average number-average molecular weight not exceeding 500), then the total weight of the first heavy fraction of the first complex structure depends partly on the total weight of the heavy fraction in the first component that has a molecular weight of at least 22,500. In another case, assuming the second component is also an oligomeric or polymeric base stock material, then the total weight of the first heavy fraction of the first complex structure depends on the total weight of the heavy fraction in the first component and the heavy fraction in the second component.

As indicated above, when the two terminal carbon chains on the molecules of the second type extend in directions that form an angle theta (at the lowest energy state at 25° C.) in the range from 0 to 180°, the ability of the two chains to attach to two pendant groups of two different molecules of the first type may be affected by the steric hindrance depending on the angle theta. Typically, the larger the angle theta (i.e., the closer it is to 180°), the smaller the steric hindrance, and the smaller the angle theta (i.e., the closer it is to 0°), the larger the steric hindrance. Therefore, in addition to the above desired concentration of maximum theoretical concentrations, it is further desired that C11×tan (theta/4) is no more than 15 wt %, 12 wt %, 10 wt %, 8 wt %, 6 wt %, 5 wt %, 4 wt %, 3 wt %, 2 wt %, or 1 wt %, and C21×tan(theta/4) is no more than 10 wt %, 8 wt %, 6 wt %, 5 wt %, 4 wt %, 3 wt %, 2 wt %, or 1 wt %, based on the total weight of the first and second components. Where the angle theta is no more than 45°, the steric hindrance is so severe that one can consider the molecule to be substantially incapable of adjoining two molecules of the first type through interaction with two pendant groups of the two molecules of the first type via van der Waals force.

When at least some of the pendant groups, especially the longest 5%, 10%, 15%, or 20%, of the side chains or terminal carbon chains of the molecules of the first type and the second type are relatively long, e.g., where they comprise at least 5 carbon atoms (or at least 6, 7, 8, 9, 10, 11, 12, 13, 14, 15, 16, 17, 18, 19, 20, 21, 22, 23, 24, 25, 26, 27, 28, 29, or 30 carbon atoms) in the longest straight chain thereof, the interaction of the long chains can result in intimate alignment of relatively long chains, resulting in relatively strong total van der Waals force between them. Furthermore, if the interacting pendant groups, side chains or terminal carbon chains of the molecules of the first type and the second type have comparative lengths, for example, where the ratio of the total number of carbon atoms in the carbon chain in the pendant group, side chain, or terminal carbon chain in a molecule of the first type to that in a molecule of the second type is in the range from r1 to r2, where r1 and r2 can be, independently, 0.50, 0.60, 0.70, 0.80, 0.90, 1.0, 1.1, 1.2, 1.3, 1.4, 1.5, 1.6, 1.7, 1.8, 1.9, 2.0, as long as $r1<r2$, strong van der Waals link can be formed relatively easily.

Furthermore, improvement in oxidation stability can be achieved by blending a PAO base stock with an AA base stock, if the pendant group length (Lpg) of pendant groups, especially the longer pendant groups (e.g., the longest 5%, 10%, 20%, 40%, or 50%), attached to the carbon backbone of the PAO molecules are comparable to the side chain group length (Lsc) of the side chain groups, especially the longer side chain groups (e.g., the longest 5%, 10%, 20%, 40%, or 50%), attached to the aromatic ring structure of the AA molecules. In general, the smaller the difference between Lpg and Lsc, the more pronounced the improvement in oxidation stability of the blend. This phenomenon has never been observed previously.

Without intending to be bound by a particular theory, it is believed that comparable lengths of the longer pendant groups on the PAO carbon backbone and the side chain groups on the aromatic ring structure lead to better alignment, stronger affinity or interaction (e.g., by van der Waals force) between the groups, leading to better mixing thereof, more protection of the sites on the PAO molecule prone to oxidation, and hence more pronounced improvement in oxidation stability of the blend.

Thus, it is desired that in the blend of the present invention, the longest 5% of the pendant groups of all of the molecules of the PAO base stock have an average pendent group length of Lpg(5%); the longest 5% of all of the side chain groups of all of the molecules of the alkylated aromatic base stock have an average side chain group length of Lsc(5%); and $|Lsc(5\%)-Lpg(5\%)|\leq D$, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(5%)>Lpg(5%).

It is further desired that in the blend of the present invention, the longest 10% of the pendant groups of all of the molecules of the PAO base stock have an average pendent group length of Lpg(10%); the longest 10% of all of the side chain groups of all of the molecules of the alkylated aromatic base stock have an average side chain group length of Lsc(10%); and $|Lsc(10\%)-Lpg(10\%)|\leq D$, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(10%)>Lpg(10%).

It is further desired that in the blend of the present invention, the longest 20% of the pendant groups of all of the molecules of the PAO base stock have an average pendent group length of Lpg(20%); the longest 20% of all of the side chain groups of all of the molecules of the alkylated aromatic base stock have an average side chain group length of Lsc(20%); and |Lsc(20%)−Lpg(20%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(20%)>Lpg(20%).

It is further desired that in the blend of the present invention, the longest 40% of the pendant groups of all of the molecules of the PAO base stock have an average pendent group length of Lpg(40%); the longest 40% of all of the side chain groups of all of the molecules of the alkylated aromatic base stock have an average side chain group length of Lsc(40%); and |Lsc(40%)−Lpg(40%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(40%)>Lpg(40%).

It is further desired that in the blend of the present invention, the longest 50% of the pendant groups of all of the molecules of the PAO base stock have an average pendent group length of Lpg(50%); the longest 50% of all of the side chain groups of all of the molecules of the alkylated aromatic base stock have an average side chain group length of Lsc(50%); and |Lsc(50%)−Lpg(50%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(50%)>Lpg(50%).

It is further desired that in the blend of the present invention, the entirety of the pendant groups of all of the molecules of the PAO base stock have an average pendent group length of Lpg(100%); the entirety of all of the side chain groups of all of the molecules of the alkylated aromatic base stock have an average side chain group length of Lsc(100%); and |Lsc(100%)−Lpg(100%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(100%)>Lpg(100%).

Typically, in the polymerization of linear alpha olefins (LAOs) using a metallocene catalyst system for making PAOs (metallocene PAOs, "mPAOs"), isomerization of the LAOs and oligomers causing mobility of the carbon-carbon double bonds can be avoided or reduced. On the contrary, when conventional non-metallocene catalyst systems such as Lewis acid-based catalysts (such as Friedel-Crafts catalysts) are used in the polymerization step, appreciable isomerization can occur. As a result, mPAOs tend to have significantly fewer short pendant groups (methyl, ethyl, C3, C4, and the like) attached to the carbon backbone thereof, in contrast to the large quantities of such short pendant groups on the carbon backbone of conventional PAOs (cPAOs). Thus, if the same LAOs are used as the monomer(s), mPAOs tend to have significantly longer Lpg(10%), Lpg(20%), Lpg(40%), Lpg(50%), and even Lpg(100%) than cPAOs. Assuming AA base stock with Lsc(10%), Lsc(20%), Lsc(20%), Lsc(40%), Lsc(50%), and Lsc(100%) is blended with the PAO, where at least one of the following conditions is met: Lsc(10%)≥Lpg(10%), Lsc(20%)≥Lpg(20%), Lsc(40%)≥Lpg(40%), Lsc(50%)≥Lpg(50%), and Lsc(100%)≥Lsc(100%), an mPAO blend would be preferred over a cPAO base stock for the purpose of the present invention.

A regio-regular structure of the PAO used for the oil composition of the present invention can also facilitate the alignment, interaction and affinity of the pendant groups, the side chain groups, and the terminal carbon chains. To that end, it is preferred that at least 50%, or 60%, 70%, 80%, 90%, 95%, even 99% of all of the pendant groups attached to the carbon backbone of the PAO molecules are regio-regular, i.e., at least 50%, or 60%, 70%, 80%, 90%, 95%, even 99% of the triads on the PAO structure are (m,m) triads or (r,r) triads. Preferably, the PAO molecules are essentially isotactic or syndiotactic.

The weight percentage of the first component (such as a PAO base stock) relative to the total weight of the first component and the second component (such as an AA base stock(s)) in the oil composition can range from: (I) P1 wt % to P wt %, where P1 and P2 can be, independently, 10, 15, 20, 25, 30, 35, 40, 45, 50, 55, 60, 65, 70, 75, 80, 85, 90, 92, 94, 95, 96, 98, or 99, as long as P1<P2; (II) preferably from 25 wt % to 95 wt %; (III) more preferably from 30 wt % to 90 wt %; (IV) still more preferably from 35 wt % to 90 wt %; (V) still more preferably from 40% to 90 wt %; and (VI) most preferably from 50 wt % to 85 wt %. It was found that when the weight percentage of PAO base stocks relative to the total weight of all PAO base stocks and AN base stocks, if used in the oil composition, is in the range of about 70 wt % to 80 wt %, the most pronounced synergistic effect (i.e., improvement) in oxidation stability can be observed.

The mole percentage of the first component (such as a PAO base stock) relative to the total moles of all first component and the second component (such as an AA base stock) in the blend can range from (I) P3 mol % to P4 mol %, where P3 and P4 can be, independently, 10, 15, 20, 25, 30, 35, 40, 45, 50, 55, 60, 65, 70, 75, 80, 85, 90, 92, 94, 95, 96, 98, or 99, as long as P3<P4; (II) preferably from 20 mol % to 90 mol %; (III) more preferably from 25 mol % to 90 mol %; (IV) still more preferably from 30 mol % to 90 mol %; (V) still more preferably from 40 mol % to 90 mol %; and (VI) most preferably from 50 mol % to 80 mol %. Alternatively, molar ratio of PAO molecules to AN molecules is in a range from R(1) to R(2), where R(1) and R(2) can be, independently, 1, 1.2, 1.4, 1.5, 1.6, 1.8, 2.0, 2.2, 2.4, 2.5, 2.6, 2.8, 3.0, 3.5, 4.0, 4.5, 5.0, 5.5, 6.0, 7.0, 8.0, 9.0, 10.0, as long as R(1)<R(2).

It has also been found that in the oil composition of the present invention comprising both a PAO base stock and an AA base stock, where each PAO molecule is aligned with a larger number of AA molecules, the improvement of oxidation stability increases accordingly. Again, without intending to be bound by a particular theory, it is believed that a larger number of AA molecules aligned with the backbone of a PAO molecule tends to provide better protection of sites prone to oxidation, better intermixing between the PAO and AA molecules, and stronger affinity between them, all resulting in higher improvement in oxidation stability.

The lubricant oil composition can also include any one or more additives as is common in the art. In one embodiment, the lubricant comprises one or more additives, such as oxidation inhibitors, antioxidants, dispersants, detergents, corrosion inhibitors, rust inhibitors, metal deactivators, anti-wear agents, extreme pressure additives, anti-seizure agents, non-olefin based pour point depressants, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and blends thereof.

Due to the enhanced improvement in oxidation stability of the base stock oil composition of the present invention, a lubricant composition incorporating the blend would have improved oxidation stability while maintaining the same quantity of antioxidants added therein. This can reduce the overall cost of the lubricant and negative effect on the overall performance of the lubricant as a result of the use of overally high concentrations of antioxidants. Alternatively, the life of the lubricant, and hence drain interval thereof, can be extended while maintaining the same quantity of antioxidant included therein. Thus, the blend may comprise an antioxidant at a concentration in the range from C(ao)1 ppm to C(ao)2 ppm, based on the total weight of the PAO base stock and the AA base stock, where C(ao)1 and C(ao)2 can be, independently, 0, 1, 5, 10, 20, 30, 40, 50, 60, 70, 80, 90, 100, 110, 120, 130, 140, 150, 160, 170, 180, 190, 200, as long as C(ao)1<C(ao)2.

Desirably, the oil composition of the present invention has an overall bromine number in the range from Nb(b1)1 to Nb(b1)2, where Nb(b1)1 and Nb(b1)2 can be, independently, 0, 0.2, 0.4, 0.5, 0.6, 0.8, 1.0, 1.5, 2.0, 2.5, 3.0, 3.5, 4.0, 4.5, 5.0, as long as NB(b1)1<Nb(b1)2.

The present invention is further illustrated by the following non-limiting examples.

EXAMPLES

In the following examples, a series of oil compositions were made and tested for SS20, SS100, and SS192. The oil compositions, as specified, comprise one or more of the following:

A First Base Stock (BS1):

an mPAO base stock made from a monomer mixture of 1-octene and 1-dodecene at a weight ratio of 70:30 (molar ratio of about 78:22) in the presence of a metallocene catalyst system, having a typical KV100 of about 300 cSt, a number-average molecular weight (Mn) of about 6660, and a molecular weight distribution as follows:

| Fraction having molecular weight higher than | Cumulative Concentration (wt %) |
|---|---|
| 40,000 | 1 |
| 30,000 | 4 |
| 25,000 | 7 |
| 22,500 | 10 |
| 20,000 | 14 |
| 15,000 | 26 |
| 10,000 | 46 |

The BS1 mPAO base stock comprises macromolecules that are primarily isotactic, and a structure schematically illustrated by (F-3a) above. Thus, each of the molecules of BS1 comprises multiple C8 pendant groups and multiple C6 pendant groups. The larger the actual molecular weight of the BS1 molecule in question, the more C8 and C6 pendant groups it contains, and the more likely it can interact with multiple long-chain terminal carbon chains of the second component or the third component to form links via significantly strong van der Waals force.

A Second Base Stock (BS2):

an NA-type base stock comprising about 90 mol % of n-pentadecylnaphthalene (single-alkyl portion, BS2-1) and about 10 mol % of alpha,beta-di-n-pentadecylnaphthalene (two-alkyl portion (BS2-2), where alpha, beta denotes the two different benzene rings in the naphthalene ring). In this base stock, BS2-2 is considered as a candidate for the second component of the oil composition of the present invention given that the two long, linear C15 alkyl can interact with pendant groups of multiple molecules of the first type (such as BS1 above) of the oil composition; BS2-1 is considered as a candidate for the third component of the oil composition of the present invention given that the single, linear C15 alkyl can interact with a pendant group of a single molecule of the first component (such as BS1 above) of the oil composition;

A Third Base Stock (BS3):

an ester base stock represented by formula (F-8) above. Each molecule of BS3 comprises two C8 terminal chains that extend in directions that form an angle theta of approximately 180°, enabling it to link to pendant groups of two molecules of the first type of the oil composition (such as BS1 above) via sufficiently strong van der Waals force to form a relatively stable and strong first complex structure, functioning as a potent second component of the oil composition of the present invention; A Fourth Base Stock (BS4): an ester base stock represented by formula (F-7) above. Each molecule of BS4 comprises three C10 terminal chains that extend in directions that form an angle theta of about 109° between any two of them. Theoretically, each of the C10 terminal carbon chain is capable of linking with pendant groups of two molecules of the first type of the first component of the oil composition (such as BS1 above) via van der Waals force. However, steric hindrance of any two molecules of the first type (such as BS1 above), especially when they are large, connected to two of the three C10 terminal carbon chains can be significant enough to reduce the stability of such first complex structure and prevent the attachment of a third molecule of the first type. Therefore, molecules of BS4 may function as a second component of the oil composition of the present invention, but its efficacy is multiplied by a factor of tan(theta/4), which is about 0.52;

A Fifth Base Stock (BS5):

an ester base stock represented by formula (F-9) above. Each molecule of BS5 comprises two C8 terminal chains that extend in directions that form an angle theta of about 60°. Theoretically, each of the C8 terminal carbon chain is capable of linking with pendant groups of two molecules of the first type of the first component of the oil composition (such as BS1 above) via van der Waals force. However, steric hindrance of any two molecules of the first type (such as BS1 above), especially when they are large, connected to two of C8 terminal carbon chains can be significant enough to reduce the stability of such first complex structure due to significant steric hindrance. Therefore, molecules of BS4 may function as a second component of the oil composition of the present invention, but its efficacy is multiplied by a factor of tan(theta/4), which is about 0.27.

A Sixth Base Stock (BS6):

a non-metallocene PAO base stock available from ExxonMobil Chemical Company, Houston, Tex., U.S.A., having a typical KV100 of about 6 cSt and a number-average molecular weight of no more than 800; the BS6 PAO molecules typically comprise two long terminal carbon chain at the end of the carbon backbone, and multiple short-chain pendant groups such as methyl, ethyl, propyl, and the like, attached to the carbon backbone thereof; long, pendant groups having five or more carbon atoms may be present on their molecules as well.

Various Additive Packages (AdPak):

Additive packages are typically added to formulated lubricant oil compositions in addition to base stocks, for multiple purposes such as enhanced performances in oxidation resistance, wear resistance, foaming, and the like. The Adpak for different oil compositions (industrial grease oil, automotive great oils, motor oils, and the like) may be very different.

Examples A1-A5: Automotive Grease Oil (AGO) Formulations

The following lubricating oil compositions were formulated and tested for various properties, especially shear stability (SS20, SS100, and SS192). These oil compositions correspond to AGO 90 grade. The same typical Adpak-1 for this grade was used in these examples at the same treat rate (concentration in weight percents). BS1 was used at appropriately the same treat rates in all these compositions. In Examples A2, A3, A4, and A5, four different co-base stocks, BS2, BS3, BS4, and BS5, were included at the same treat rate of about 20 wt %, and a same co-base stock, BS6, was included essentially as a low-viscosity diluent at very close treat rates. In Example A1, only BS6 was used as the co-base stock. These examples showed differing SS192 of the compositions, which are due to the interaction between the molecules of BS1 (especially the large molecular-weight fraction, such as those having molecular weights of at least 22,500) and the molecules of BS2, BS3, BS4, and BS5. Because the total moles of AN1, BS3, BS4, and BS5 molecules are much larger than the total moles of BS1 at the shown treat rates, the maximum theoretical concentrations of shearable complex structures having equivalent molecular weights of at least, e.g., 40,000, or 45,000, or 50,000, or even 60,000 are determined by the concentration of the heavy fraction in BS1 and the molecular structure of BS2, BS3, BS4, and BS5, respectively.

In Example A3, because the two terminal carbon chains in BS3 are spread at an angle theta of about 180° across, each of the BS3 molecules would have strong capability of joining two BS1 molecules to form a complex structure having the least steric hindrance. This contributes to the highest SS192 of Example A3.

In Example A2, BS2 comprises about 90% by mole of molecules having a single long terminal carbon chain (side chain connected to a naphthalene nucleus), which are incapable of joining two BS1 molecules through interaction with long pendant groups via van der Waals force. BS2 further comprises about 10% by mole of molecules having two long terminal carbon chains that are spread at an angle theta of about 180°. Similar to BS3 molecules, these two-arm BS2 molecules have strong ability to join two BS1 molecules to form stable complex structures. However, because of the significantly smaller concentration of such two-arm molecules than in Example A3, the oil of Example A2 demonstrated much smaller SS192 than Example A3.

In Example A4, BS4 comprises three terminal carbon chains spread at an angle theta of about 109° relative to each other in the space. While theoretically it is possible that all three may interact with the long, pendant groups in BS1 to form shearable complex structures, because of the closeness of these three long arms, once one of them aligns with a long pendant group of one BS1 molecule, the possibility of a second long arm aligns with a second pendant group of the same or different BS1 molecule is very significantly reduced. Therefore, the oil composition of Example A4 demonstrated a SS192 similar but smaller than that of Example A2, and much smaller than that of Example A3.

In Example A5, BS5 comprises two terminal carbon chains spread at an angle theta of about 60° relative to each other (considering the rotational possibility of the O—C linkage in the ester linkages). While theoretically it is possible that both may interact with the long, pendant groups in BS1 to form shearable complex structures, because of the closeness of the two long terminal carbon chains, once one of them aligns with a long pendant group of one BS1 molecule, the possibility of a second long terminal carbon chain aligning with a second pendant group of the same or different BS1 molecule is very significantly reduced due to significant steric hindrance. Therefore, the oil composition of Example A5 demonstrated a SS192 lower than that of Examples A2, A3, and A4.

As to Example A1, because no additional base stock materials having two arms capable of attaching to two BS1 molecules are included, other than BS6 and BS1 per se, the oil composition demonstrated the lowest SS192 among all Examples A1, A2, 1C, A4, and A5. Example A1 also shows that the interaction between and among the molecules of SB1 and molecules of SB7 are negligible compared to the molecules of SB1 and molecules of BS2, BS3, BS4, and BS5 with respect to contribution to SS192. Because SB7 and BS2, BS3, BS4, and BS5 are all fairly stable, small molecules per se, it is believed that their interaction will not result in complex structures sufficiently large and stable to result in significant shear breakage under the testing conditions.

TABLE I

| | Examples | | | | |
|---|---|---|---|---|---|
| Composition | A1 (wt %) | A2 (wt %) | A3 (wt %) | A4 (wt %) | A5 (wt %) |
| BS6 | 68.9 | 48.7 | 46.8 | 48.1 | 48.2 |
| BS1 | 23.6 | 23.8 | 25.7 | 24.4 | 24.3 |
| AdPak-1 | 7.5 | 7.5 | 7.5 | 7.5 | 7.5 |
| BS2 | — | 20.0 | — | — | — |
| BS3 | — | — | 20.0 | — | — |
| BS4 | — | — | 0 | 20.0 | — |
| BS5 | — | — | — | — | 20.0 |
| Properties | A1 | A2 | A3 | A4 | A5 |
| KV40 | 95.05 | 94.84 | 86.08 | 88.74 | 97.00 |
| KV100 | 15.38 | 15.05 | 15.28 | 14.93 | 15.27 |
| VI | 172 | 167 | 188 | 177 | 166 |
| SS192 | 1.3 | 8.4 | 12.1 | 6.9 | 6.0 |
| Theta (°) | — | 180 | 180 | 109.75 | 60 |
| Tan(theta/4) | — | 1 | 1 | 0.52 | 0.27 |

Examples B1-B5: Industrial Grease Oil (IGO) Formulations

Similar to Examples A1-A5, a series of oil formulations B1-A5 were formed from the same base stocks and tested for properties including SS192. These oil compositions correspond to industrial grease oil IGO VG100 grade. A differing additive package, Adpak-2, specific for this grade was used. Composition and properties Data are included in TABLE II below.

TABLE II

| Composition | Examples B1 (wt %) | B2 (wt %) | B3 (wt %) | B4 (wt %) | B5 (wt %) |
|---|---|---|---|---|---|
| BS6 | 73.6 | 53.5 | 50.9 | 52.7 | 52.7 |
| BS1 | 24.9 | 25.0 | 27.6 | 25.8 | 25.8 |
| AdPak-2 | 1.5 | 1.5 | 1.5 | 1.5 | 1.5 |
| BS2 | — | 20.0 | — | — | — |
| BS3 | — | — | 20.0 | — | — |
| BS4 | — | — | 0 | 20.0 | — |
| BS5 | — | — | — | — | 20.0 |
| **Properties** | **B1** | **B2** | **B3** | **B4** | **B5** |
| KV40 | 93.51 | 92.57 | 83.27 | 87.23 | 95.77 |
| KV100 | 15.35 | 15.01 | 15.10 | 14.93 | 15.42 |
| VI | 174 | 171 | 192 | 180 | 171 |
| SS192 | 6.8 | 5.1 | 7.9 | 5.6 | 4.2 |
| Theta (°) | — | 180 | 180 | 109 | 60 |
| Tan(theta/4) | — | 1 | 1 | 0.52 | 0.27 |

Similar to Examples A1-A5, among Examples B2, B3, B4, and B5, Example B3 comprising BS3 as the co-base stock demonstrated the highest SS192, and Example B5 comprising BS5 demonstrated the lowest SS192, while Examples B2 and B5 demonstrated similar SS192 between Examples B3 and B5. Example B1, however, showed significantly higher SS192 compared to Example A1, showing that the Adpak-2 resulted in significant SS192 in Example B1 where no co-base stock other than BS1 and BS6 are present. In Examples B2, B3, B4, and B5, the effective of Adpak-2 became largely invisible, because the interaction between the large molecules of SB1 and the molecules of BS2, BS3, BS4, and BS5 dominates.

Examples C1-C18: Formulations without Additive Package

To study the effect of the interactions between co-base stocks on the SS192, a series of oil compositions C1-C18 were made from mixtures of SB1, SB7, and one of BS2, BS3, BS4, and BS5 and then tested for properties including SS192. Data are reported in TABLE IIIa and TABLE IIIb below. Data presented in TABLE IIIa and TABLE IIIb are plotted into bar charts shown in FIG. 1.

As can be clearly seen from FIG. 1, for oil compositions comprising BS1/BS3 mixture, the higher the concentration of BS3, the larger the SS192 measured. This is consistent with above theory: co-base stocks having molecules with two-arms extending in directions having an angle theta of about 180° tend to have the strongest capability to link large molecules of BS1 to form large, stable, shearable complex structures.

For oil compositions comprising BS1/BS2 mixtures, when the concentration of BS2 increased from 5 wt % to about 10 wt %, SS192 increased dramatically. Without intending to be bound by a particular theory, it is believed this is due to the fact that the two-arm molecules in BS2 were able to form a significantly larger numbers of shearable, stable complex structures with the large molecular weight BS1 molecules, when BS2 concentration increased from 5 wt % to 10 wt %. However, as BS2 concentration increased further from 10 wt % to 15 wt %, then to 20 wt %, and then to 30 wt %, the total number of shearable, stable complex structures formed actually reduced slightly, because the much larger number of one-arm molecules contained in BS2 competed against the two-arm molecules (dilution effect), forcing more two-arm molecules to link to single large BS1 molecules, effectively reducing the total moles of shearable, stable complex structures.

For oil compositions comprising BS1/BS4 mixtures, when the concentration of BS4 increased from 5 wt % to 10 wt %, SS192 decreased dramatically. Without intending to be bound by a particular theory, it is believed this is due to: (i) at low concentration such as 5 wt %, the BS4 molecules are allowed to link all large, BS1 molecules to form stable, shearable complexes. At 10 wt %, however, competition from other BS4 molecules (or dilution effect) results in lower centration of shearable complex structures than at 5 wt % because large BS1 molecules tend to attach to a single BS4 molecules. As concentration increases, however, from 10 wt % to 15 wt %, and then to 20 wt %, however, because each large BS1 molecule has more BS4 molecules attached to it through more pendant groups, the possibility of one or more BS4 molecules are attached to two large BS1 molecule again increases, hence the increase SS192.

For oil compositions comprising BS1/BS5 mixtures, the SS192 remains substantially stable from 5 wt % to 10 wt %, and then to 15 wt %. This is because the total amount of shearable, large complex structures between large BS1 molecules and the BS5 molecules remains substantially constant given the locations of the two-arms on the BS5 molecules—only a small portion of the BS1 molecules are cross-linked before 15 wt %. However, total quantity of shearable, stable complexes between BS1 and BS5 molecules increased significantly from 15 wt % to 20 wt % because each large BS1 molecule now has more BS5 molecules attached to it through more pendant groups, the possibility of one or more BS4 molecules are attached to two large BS1 molecule again increases substantially albeit the steric hindrance, hence the increase in SS192.

TABLE IIIa

| Composition | Example C1 (wt %) | C2 (wt %) | C3 (wt %) | C4 (wt %) | C5 (wt %) | C6 (wt %) | C7 (wt %) | C8 (wt %) | C9 (wt %) |
|---|---|---|---|---|---|---|---|---|---|
| BS6 | 69.70 | 69.00 | 69.50 | 69.70 | 63.90 | 62.60 | 64.00 | 64.50 | 59.50 |
| BS1 | 25.30 | 26.00 | 25.50 | 25.30 | 26.10 | 27.40 | 26.00 | 25.50 | 25.50 |
| BS2 | 5.00 | — | — | — | 10.00 | — | — | — | 15.00 |
| BS3 | — | 5.00 | — | — | — | 10.00 | — | — | — |
| BS4 | — | — | 5.00 | — | — | — | 10.00 | — | — |
| BS5 | — | — | — | 5.00 | — | — | — | 10.00 | — |
| **Properties** | **C1** | **C2** | **C3** | **C4** | **C5** | **C6** | **C7** | **C8** | **C9** |
| KV40 (cSt) | 94.77 | 90.37 | 92.96 | 93.99 | 97.95 | 88.49 | 92.16 | 94.19 | 94.91 |
| KV100 (cSt) | 15.47 | 15.27 | 15.44 | 15.41 | 15.85 | 15.32 | 15.43 | 15.39 | 15.38 |

TABLE IIIa-continued

| | | | | | | | | | |
|---|---|---|---|---|---|---|---|---|---|
| VI | 174 | 179 | 177 | 174 | 173 | 184 | 178 | 173 | 172 |
| SS192 | 9.2 | 6.6 | 15.8 | 8.8 | 16.9 | 8.4 | 8.0 | 7.9 | 14.6 |

TABLE IIIb

| | Example | | | | | | | | |
|---|---|---|---|---|---|---|---|---|---|
| Composition | C10 (wt %) | C11 (wt %) | C12 (wt %) | C13 (wt %) | C14 (wt %) | C15 (wt %) | C16 (wt %) | C17 (wt %) | C18 (wt %) |
| BS6 | 56.30 | 58.70 | 59.30 | 54.40 | 50.90 | 53.90 | 54.10 | 43.00 | 38.70 |
| BS1 | 28.70 | 26.30 | 25.70 | 25.60 | 29.10 | 26.10 | 25.90 | 27.00 | 31.30 |
| BS2 | — | — | — | 20.00 | — | — | — | 30.00 | |
| BS3 | 15.00 | — | — | — | 20.00 | — | — | — | 30.00 |
| BS4 | — | 15.00 | — | — | — | 20.00 | — | — | — |
| BS5 | — | — | 15.00 | — | — | — | 20.00 | — | — |
| Properties | C10 | C11 | C12 | C13 | C14 | C15 | C16 | C17 | C16 |
| KV40 (cSt) | 87.16 | 92.2 | 94.81 | 94.82 | 82.09 | 88.22 | 95.83 | 97.21 | 82.35 |
| KV100 (cSt) | 15.41 | 15.55 | 15.4 | 15.32 | 14.93 | 15.05 | 15.4 | 15.44 | 15.45 |
| VI | 188 | 180 | 172 | 171 | 192 | 180 | 170 | 169 | 200 |
| SS192 | 8.2 | 10.2 | 8.4 | 13.4 | 14.0 | 14.4 | 15.5 | 11.2 | 15.6 |

The invention claimed is:

1. An oil composition comprising a first component and a second component different from the first component, wherein:

the first component is a base stock comprising multiple molecules of a first type each having multiple pendant groups, where (i) the average pendant group length of the longest 5%, by mole, of the pendant groups of all of the molecules of the first type have an average pendant group length of Lpg(5%), where Lpg(5%) ≥5.0; and (ii) a portion of the molecules of the first type have a number-average molecular weight greater than or equal to 20,000;

the second component comprises multiple molecules of a second type each comprising two terminal carbon chains, where (i) the number-average molecular weight of the second component is no greater than 2,000; and (ii) the two terminal carbon chains have chain lengths equal to or greater than 5.0 and do not share a common carbon atom;

a single molecule of the second type is capable of adjoining two molecules of the first type via van der Waals force between the pendant groups of the molecules of the first type and the two terminal carbon chains in the single molecule of the second type to form a first complex structure, the first complex structures comprising a first heavy fraction thereof having an equivalent number-average molecular weight of at least 45,000;

wherein the molecules of the first type comprise polyalpha-olefin ("PAO") molecules having an average isotacticity of at least 60 mol %;

wherein the first component has a Kv(100° C.) of less than 400 cSt; and wherein the oil composition comprises from 5 to 35 weight percent of the second component relative to the total weight of the first and second components and from 65 to 95 weight percent of the first component relative to the total weight of the first and second components.

2. The oil composition of claim 1, wherein Lpg(5%)≥8.0.

3. The oil composition of claim 1, wherein:

with respect to the molecules of the second type, at least two of the terminal carbon chains have chain length equal to or greater than 0.80*Lpg(5%).

4. The oil composition of claim 1, wherein:

with respect to the molecules of the second type, at least two of the terminal carbon chains have chain length equal to or greater than 12.

5. The oil composition of claim 1, wherein:

the molecules of the first type comprise PAO molecules having an average isotacticity of at least 90 mol %.

6. The oil composition of claim 1, wherein:

the second component comprises an alkylated aromatic hydrocarbon base stock.

7. The oil composition of claim 1, wherein the total maximum theoretical concentration of the first heavy fraction of the first complex structure, based on the total weight of the first component and the second component, is C11 (max) wt %; and C11(max)≤20.

8. The oil composition of claim 1, wherein the second component is selected from: esters of long-chain alkyl carboxylic acid and polyols; and esters of long-chain alkyl alcohols with polycarboxylic acid; phosphoric acid; sulfuric acids; or sulphonic acids.

9. The oil composition of claim 1, having shear stability performances as follows:

SS20≤10%;

SS100≤5%;

SS192≤10%; and

SS192>SS100.

10. The oil composition of claim 1, further comprising a third component differing from the first component and the second component, wherein the third component comprises multiple molecules of a third type, and individual molecules of the third type are capable of adjoining no more than one molecule of the first type via van der Waals force to form a stable complex structure.

11. The oil composition of claim 6, wherein multiple molecules of the second type comprise two alkyl groups connected to aromatic ring(s) extending in directions that form an angle theta in the range from 120° to 180°, such that each is capable of attaching to a pendant group of two differing molecules of the first type via van der Waals force simultaneously.

12. The oil composition of claim 10, wherein:

the molecules of the third type comprise only one or zero terminal carbon chain having a chain length equal to or greater than 5.0.

13. The oil composition of claim 10, wherein:

the molecules of the third type comprise two carbon chains that extend in directions that form an angle theta in the range from 0° to 45° and that are incapable of attaching to pendant groups of two differing molecules of the first type via van der Waals force simultaneously substantially free of steric hindrance.

14. The oil composition of claim 10, wherein:

the third component is an alkylated aromatic hydrocarbon base stock.

15. The oil composition of claim 10, wherein multiple molecules of the third type comprise two alkyl groups connected to aromatic ring(s) extending in directions that form an angle theta in the range from 0° to 45°, and are incapable of attaching to pendant groups of two differing molecules of the first type simultaneously substantially free of steric hindrance.

16. The oil composition of claim 10, wherein the third component is a lubricant additive component.

17. The oil composition of claim 10, wherein the molecules of the third type have a number-average molecular weight of at most 2000.

18. A process for forming an oil composition having a high shear stability performance, comprising the following steps:

(I) providing a first component in an amount ranging from 65 to 95 weight percent of the oil composition relative to the total weight of the first and second components comprising multiple molecules of the first type each having multiple pendant groups, where the average pendant group length of the longest 5%, by mole, of the pendant groups of all of the molecules of the first type have an average pendant group length of Lpg(5%), where Lpg(5%)≥5.0;

wherein the first component has a Kv(100° C.) of less than 400 cSt; and (II) providing a second component in an amount ranging from 5 to 35 weight percent of the oil composition relative to the total weight of the first and second components comprising multiple molecules of the second type each comprising at least two terminal carbon chains that do not share a common carbon atom, wherein at least two of the terminal carbon chains have chain lengths equal to or greater than 5.0; a single molecule of the second type is capable of adjoining two molecules of the first type via van der Waals force to form a first complex structure, the first complex structures comprising a first heavy fraction thereof having equivalent number-average molecular weight of at least 45,000.

19. The process of claim 18, further comprising:

(III) mixing the first component in a first quantity and the second component in a second quantity such that the total maximum theoretical concentration of the first heavy fraction of the first complex structure, based on the total weight of the first component and the second component, is C11(max) wt %; and C11(max)≤20.

20. The process of claim 19, wherein the two terminal carbon chains in the molecules of the second type extend in directions that form an angle theta no greater than 180° when the molecules of the second type are in lowest energy state at 25° C., and C11(max)×tan(theta/4)≤10.

21. The process of claim 19, further comprising:

(IV) providing a third component differing from the first component, wherein the third component comprises multiple molecules of the third type, and an individual molecule of the third type is capable of adjoining no more than one molecule of the first type via van der Waals force to form a stable first complex structures; and wherein step (III) also comprises mixing the third component in a third quantity with the first component and the second component.

22. The process of claim 20, wherein C11(max)≤10.

23. The oil composition of claim 21, wherein the two terminal carbon chains in the molecules of the second type of the second component extend in directions that form an angle theta no greater than 180° when the molecules of the second type are in lowest energy state at 25° C., and C11(max)×tan(theta/4)≤10.

24. The oil composition of claim 21, wherein C11(max) ≤10.

25. The oil composition of claim 21, wherein:

the first heavy fraction of the first complex structure comprises a second heavy fraction thereof having equivalent number-average molecular weight of at least 60,000, and the total maximum theoretical concentration of the second heavy fraction of the first complex structure, based on the total weight of the first component and the second component, is C21(max) wt %, and C21(max)×tan (theta/4)≤5.

26. The oil composition of claim 21, wherein:

100°≤theta≤180°.

27. The oil composition of claim 25, wherein C21(max) ≤5.

* * * * *